US012178315B2

(12) United States Patent
Cabon et al.

(10) Patent No.: US 12,178,315 B2
(45) Date of Patent: Dec. 31, 2024

(54) APPLICATOR FOR APPLYING MAKEUP TO HUMAN KERATIN FIBERS, IN PARTICULAR THE EYEBROWS

(71) Applicant: L'OREAL, Paris (FR)

(72) Inventors: Chloe Cabon, Clichy (FR); Alain Berhault, Clichy (FR)

(73) Assignee: L'OREAL, Paris (FR)

( * ) Notice: Subject to any disclaimer, the term of this patent is extended or adjusted under 35 U.S.C. 154(b) by 320 days.

(21) Appl. No.: 17/642,105

(22) PCT Filed: Jul. 31, 2020

(86) PCT No.: PCT/EP2020/071721
§ 371 (c)(1),
(2) Date: Mar. 10, 2022

(87) PCT Pub. No.: WO2021/047824
PCT Pub. Date: Mar. 18, 2021

(65) Prior Publication Data

US 2022/0354244 A1 Nov. 10, 2022

(30) Foreign Application Priority Data

Sep. 11, 2019 (FR) ..... 1910009

(51) Int. Cl.
*A46B 11/00* (2006.01)
*A45D 34/04* (2006.01)
(Continued)

(52) U.S. Cl.
CPC ..... *A46B 9/021* (2013.01); *A45D 34/045* (2013.01); *A45D 40/262* (2013.01);
(Continued)

(58) Field of Classification Search
CPC ..... A45D 40/262; A45D 40/265; A46B 2200/1046; A46B 2200/1053
(Continued)

(56) References Cited

U.S. PATENT DOCUMENTS 11,064,798 B2 * 7/2021 Sanchez ..... A45D 40/267
2005/0271454 A1 12/2005 Gueret
(Continued)

FOREIGN PATENT DOCUMENTS

EP 1 600 079 A1 11/2005
EP 1 611 817 A1 1/2006
(Continued)

OTHER PUBLICATIONS

International Search Report mailed on Oct. 21, 2020 in PCT/EP2020/071721 filed on Jul. 31, 2020 (3 pages).
(Continued)

*Primary Examiner* — Jennifer C Chiang
(74) *Attorney, Agent, or Firm* — Oblon, McClelland, Maier & Neustadt, L.L.P.

(57) ABSTRACT

An applicator for applying makeup to keratin fibers, the applicator having an applicator member designed to apply the composition to said fibers, notably present in the form of tufts, and preferably to the underlying skin, the applicator member having a plastics body, the cross section of which is flattened along at least a part of its length, the flattened cross section defining a first direction corresponding to the width of the section and a second direction, perpendicular to the first, corresponding to the thickness of the section, the thickness being less than the width, the body having at least one first application face delimiting on one side the thickness of the flattened cross section, spikes attached to the first application face, and flocking present on a portion of the surface of the body adjacent to the distal end thereof.

18 Claims, 4 Drawing Sheets

(51) Int. Cl.

| | |
|---|---|
| ***A45D 40/26*** | (2006.01) |
| ***A46B 1/00*** | (2006.01) |
| ***A46B 9/02*** | (2006.01) |
| ***A46D 1/00*** | (2006.01) |

(52) U.S. Cl.
CPC ..... *A45D 40/265* (2013.01); *A46B 1/00* (2013.01); *A46B 9/026* (2013.01); *A46D 1/0207* (2013.01); *A46B 2200/1046* (2013.01); *A46B 2200/1053* (2013.01)

(58) Field of Classification Search
USPC ..... 401/126, 129
See application file for complete search history.

(56) References Cited

U.S. PATENT DOCUMENTS

| | | | | |
|---|---|---|---|---|
| 2006/0002758 | A1 | 1/2006 | Gueret | |
| 2010/0294297 | A1 | 11/2010 | Gueret | |
| 2016/0360860 | A1 | 12/2016 | Berhault et al. | |
| 2018/0027943 | A1 | 2/2018 | Rosario-Melendez et al. | |
| 2019/0313770 | A1* | 10/2019 | Hamida | A46B 11/0006 |
| 2020/0367631 | A1* | 11/2020 | Bianco | A45D 34/046 |

FOREIGN PATENT DOCUMENTS

| | | | |
|---|---|---|---|
| FR | 2 762 494 | A1 | 10/1998 |
| FR | 2 933 854 | A1 | 1/2010 |
| FR | 2 951 359 | A1 | 4/2011 |
| FR | 2 980 677 | A1 | 4/2013 |
| FR | 3 014 654 | A1 | 6/2015 |
| WO | WO 2015/087199 | A1 | 6/2015 |
| WO | WO 2019/045494 | A2 | 3/2019 |

OTHER PUBLICATIONS

Preliminary French Search Report dated May 26, 2020 in French Application 1910009 filed on Sep. 11, 2019 (3 pages, with Translation of Categories).

* cited by examiner

APPLICATOR FOR APPLYING MAKEUP TO HUMAN KERATIN FIBERS, IN PARTICULAR THE EYEBROWS

TECHNICAL FIELD

The present invention relates to the making up of human keratin fibers, in particular not the eyelashes of the eyelid. The invention relates more particularly to the making up of the eyebrows, beard or roots of the hair, which may have an organization of the fibers in tufts, as opposed to the eyelashes of the eyelid, which are organized as a more or less rectilinear line.

PRIOR ART

Numerous packaging and application devices have been proposed for applying makeup to the eyebrows.

Makeup is not applied to the eyebrows in the same way as it is applied to the eyelashes of the eyelid. The making up of the eyebrows usually aims to give the impression of a greater density of hairs or to correct the contour of the eyebrows, whereas the making up of the eyelashes of the eyelid seeks rather to lengthen the eyelashes and make them more visible.

Numerous techniques of applying makeup to the eyebrows most often involve depositing product simultaneously on the hairs of the eyebrows and on the underlying skin, in order to visually fill to a certain extent the spaces between the hairs and/or the areas of the eyebrows that have a lower density of hairs than the rest of the eyebrows.

A usual manner of making up the eyelashes involves the use of a pencil or a felt tip, making it possible to draw on the skin lines that imitate the hairs of the eyebrows, so as to give the illusion of a greater density of hairs and/or to outline the contour of the eyebrows so as to correct it. The use of the pencil or felt tip is often preceded or followed by the combing of the eyebrows with the aid of a brush or a comb that is not loaded with product. This technique is relatively time consuming and requires a great deal of attention on the part of the user.

Another known technique combines the use of a fine brush with a beveled tip to trace the contour of the eyebrows and to load the hairs of the eyebrows with product, and of a brush or a comb to comb the eyebrows.

Sometimes, generally after the eyebrows have been made up, a composition such as a fixing gel is applied thereto with the aid of a brush with a twisted core of suitable shape or of a foam end piece.

Some people, in order to make up their eyebrows, use mascara intended to be applied to the eyelashes of the eyelid, by picking up the product, from the mascara brush that has just been withdrawn from its container, with the aid of a fine brush with a beveled tip, which is then used to make up the hairs of the eyebrows. Next, a brush without any product is generally used to comb the eyebrows.

Thus, making up the eyebrows frequently involves multiple applicators, with hand actions that are not always simple or rapid.

Furthermore, numerous mascara applicators are described in the publications FR2762494, FR3014654, US2010/0294297A1, FR2951359, FR2980677 or FR2933854. Although said documents mention the possibility of applying the composition to the eyebrows, in practice the applicators described thereon are more specifically designed for applying makeup to the eyelashes of the eyelid.

DISCLOSURE OF THE INVENTION

Therefore, there is a need to further improve applicators intended for applying makeup to the eyebrows, beard or roots of the hair, in order in particular to obtain a satisfactory makeup result quickly and easily.

SUMMARY OF THE INVENTION

The invention aims to meet this need and its subject, according to a first of its aspects, is an applicator for applying makeup to keratin fibers, preferably not the eyelashes of the eyelids, in particular for making up the eyebrows, beard or roots of the hair, having an applicator member designed to apply the composition to said fibers, notably present in the form of tufts, and preferably to the underlying skin, the applicator member having:

- a plastics body, the cross section of which is flattened along at least a part of its length, the flattened cross section defining a first direction corresponding to the width of the section and a second direction, perpendicular to the first, corresponding to the thickness of the section, the thickness being less than the width, the body having at least one first application face delimiting on one side the thickness of the flattened cross section,
- spikes attached to the first application face,
- flocking present on a portion of the surface of the body adjacent to the distal end thereof.

The applicator according to the invention makes it possible to obtain good makeup results on the eyebrows or other keratin fibers arranged in tufts, such as the hairs of the beard or head hair for application to the roots thereof, while maintaining relatively simple hand actions.

The flocking present at the end of the applicator member can be used as an applicator end piece for applying the composition to the skin underlying the eyebrows or other keratin fibers arranged in tufts, such as the hairs of the beard or head hair for application to the roots thereof. For their part, the spikes make it possible to comb the keratin fibers, in particular the hairs of the eyebrows, while loading them with product.

The user can deposit the composition on the keratin fibers to be made up with it being possible to exert a pressure force with the applicator on the areas of the body bearing these fibers, such as the eyebrow arch in order to make up the eyebrows, the face in order to make up the beard or the scalp in order to make up the hair roots, in order to deposit the composition and/or style the fibers. In the process, the applicator can deposit the composition on the underlying skin, and thus fill any areas with a low density of keratin fibers, in particular via the flocked end of the applicator.

Preferably, the applicator's body is monolithically in one piece, and moulded in its final configuration.

Preferably, the flocking continuously covers the entire surface of the body over a given distance from the distal end thereof to the proximal end thereof. The boundary between the flocking and the non-flocked part is situated for example at the base of a row of spikes that is closest to the distal end. This has the benefit of a relatively extensive flocked surface, extending for example over more than 5 mm, which gives the applicator member autonomy once it has been loaded with composition.

In some examples, there is no flocking between the spikes and the side edges of the applicator. Therefore, the area comprising spikes is relatively large and allows to perform an effective makeup of the keratin fibers. Side spikes may be close to the side edges of the applicator.

The flocking may extend over a distance measured from the distal to the proximal end of less than 10 mm, better of less than 6 mm.

Preferably, the flocking extends between the distal end of the body and the spikes that are the closest to the distal end, the applicator lacking flocking other than in this zone.

The body may have a second application face delimiting, on the opposite side, the thickness of the flattened cross section, this second application face bearing spikes. This makes it possible to have two application faces for making up the eyebrows and other keratin fibers, other than the eyelashes of the eyelid, and to further increase the autonomy of the applicator, and in particular to make up the right and left eyebrows without it being necessary to dip the applicator member in the reservoir of cosmetic composition again.

Preferably, the applicator member is symmetric with respect to a median plane of symmetry for the body, intersecting the latter half-way through the thickness thereof. Thus, the properties of the applicator are the same for both faces, and the user can use either one or the other.

The first application face is preferably concave toward the outside. This makes it possible to form a reserve of composition on the application face, in the hollow thereof, thereby increasing the autonomy of the applicator.

Preferably, the spikes that extend over the first application face have different lengths. This makes it possible to benefit, on the applicator member, from longer spikes that are less loaded with product for combing the hairs, and from shorter spikes that are less wiped and are thus loaded with more product. In addition, the long spikes make it easier to pick up fibers in the composition, when the latter contains them, and the shorter spikes make it possible to keep these fibers on the surface of the applicator and to subsequently pass them onto the keratin fibers, in particular onto the hairs of the eyebrows. If there were only long spikes, the fibers could tend to remain trapped within the applicator member.

The spikes can be arranged in various ways on the application face. Preferably, the applicator member has on the first application face rows of spikes that are parallel to the longitudinal axis of the body.

The first application face may have at least one row of spikes within which long spikes alternate with shorter spikes.

The first application face preferably has, when seen from above, a tapered shape preferably with a tapered end situated at the distal end of the applicator. The first application face may in particular have a tapered shape that narrows in the direction of the distal end of the applicator member, in particular a droplet shape, the narrowest end of this droplet shape preferably being provided at the distal end of the body. The first application face may have, when seen from above, a shape other than a droplet shape, in particular a triangle or rhombus shape, inter alia. This makes it possible to have a narrower distal end, which can be used to draw a line on the skin when precise application needs to be carried out in an area having hairs of small size. This makes it possible in particular to draw the tail of the eyebrow, which is very thin.

The free end of the spikes attached to the first application face may define a surface that is convex toward the outside. This makes it easier to use the applicator member to comb the eyelashes.

The spikes attached to the first application face may comprise a first group of spikes that are parallel to one another and perpendicular to said median plane of symmetry, close to the distal end of the applicator member, and a second group of spikes that each make a non-right angle with said median plane of symmetry. The spikes of this second group may in particular be oriented forward, that is to say toward the distal end.

The height of the spikes attached to the first application face is preferably between 1 and 2.5 mm.

The applicator according to the invention is furthermore suitable for picking up a composition comprising fibers. The concave shape of the application face helps to pick up the fibers.

A further subject of the invention, according to another of its aspects, is a packaging and application device having:

- an applicator according to the invention,
- a container containing a composition for making up human keratin fibers, in particular the eyebrows, beard or roots of the hair, to be applied with the aid of said applicator.

Preferably, the composition comprises fibers. The latter make it possible to fill any gaps present in the implantation of the eyebrows, and to make the latter more dense. Such a composition comprising fibers can also be employed to fill any gaps present in the implantation of the beard, for example caused by loss of hair, or in the implantation of the head hair.

A "fiber" should be understood as being an object of length L and diameter D where L is greater than D, and preferably much greater than D, D being the diameter of the circle in which the section of the fiber is inscribed. In particular, the ratio L/D (or aspect ratio) is chosen in the range from 3.5 to 2500, preferably from 5 to 500 and better still from 5 to 150.

The fibers that usable in the composition of the invention may be fibers of synthetic or natural, and mineral or organic, origin. They may be relatively short or long, individual or organized, for example braided, hollow or solid. They may have any shape and may in particular have a circular or polygonal (square, hexagonal or octagonal) cross section depending on the specific application envisaged. In particular, their ends are blunted and/or smoothed to prevent injury.

In particular, the fibers have a length ranging from 1 μm to 10 mm, preferably from 0.1 mm to 6 mm, better still from 0.3 mm to 4 mm and even better still from 0.2 mm to 2 mm. Their section may be contained in a circle with a diameter ranging from 2 nm to 500 μm, preferably ranging from 100 nm to 100 μm and better still from 1 μm to 50 μm. The weight or yarn count of the fibers is often given in denier or decitex and represents the weight in grams per 9 km of yarn. Preferably, the fibers according to the invention have a yarn count chosen in the range from 0.01 to 10 denier, preferably from 0.1 to 2 denier and better still from 0.3 to 0.7 denier.

The fibers that are usable in the compositions according to the invention can be chosen from rigid or non-rigid fibers, and they may be of synthetic or natural, and mineral or organic, origin.

Furthermore, the fibers may or may not be surface-treated, may be coated or uncoated, and may be colored or uncolored.

As fibers that are usable in the compositions according to the invention, mention may be made of non-rigid fibers such as polyamide (Nylon®) fibers or viscose fibers (also known as rayon fibers), or rigid fibres such as polyimideamide fibers, such as those sold under the names Kermel® and Kermel Tech® by the company Rhodia or poly(p-phenyleneterephthalamide) (or aramid) fibres sold in particular under the name Kevlar® by the company DuPont de Nemours.

The fibers that are usable in the compositions according to the invention may be fibers of natural origin, among which cotton fibers, bamboo fibers or hemp fibers, or a mixture thereof, can be mentioned in a nonlimiting manner.

The fibers may be present in a content ranging from 0.1% to 30% by weight, more particularly from 0.1% to 25% by weight, and preferably from 0.3% to 10% by weight, relative to the weight of the composition.

Preferably, the content of fibers, if they are present in the composition P, is less than or equal to 10% by weight, and preferably less than or equal to 5% by weight, relative to the weight of the composition.

As a variant, the content of fibers, if they are present in the composition P, ranges from 2 to 25% by weight relative to the weight of the composition.

The composition also preferably contains pigments, in particular blacks, for example iron oxides.

A further subject of the invention, according to another of its aspects, is a method for making up human keratin fibers and preferably the underlying skin, said fibers being in particular organized in tufts, in particular a method for making up the eyebrows or other areas that have hairs and where there is interest in making up both the keratin fibers and the skin, for example the beard or roots of the hair, this method comprising the application of the composition simultaneously to said fibers and preferably to the underlying skin by means of the applicator according to the invention.

BRIEF DESCRIPTION OF THE DRAWINGS

The invention may be understood better from reading the following detailed description of a nonlimiting exemplary embodiment thereof, and from studying the appended drawing, in which.

DETAILED DESCRIPTION

Figure 1:
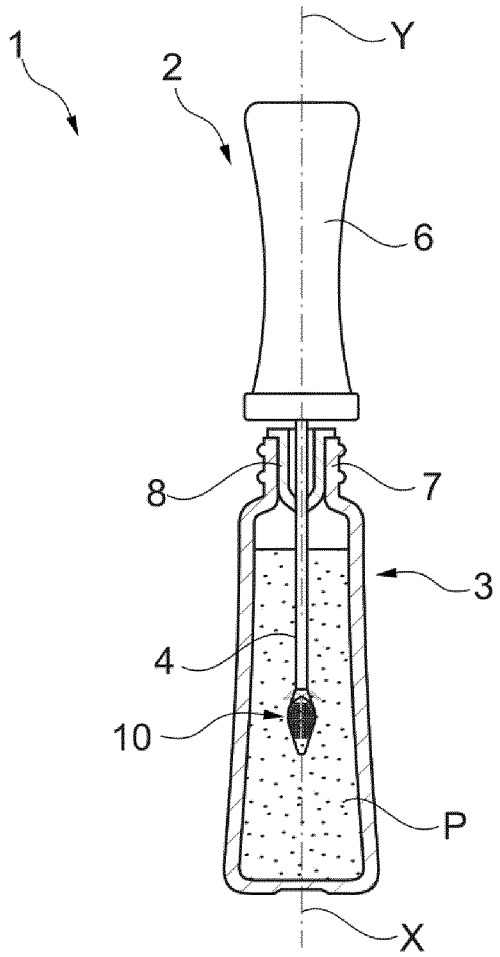
FIG. 1 schematically shows a packaging and application device according to the invention.

FIG. 1 schematically illustrates a packaging and application device 1 according to one embodiment of the invention.

The device 1 has an applicator 2 according to the invention and a container 3 containing a composition P to be applied to the eyebrows or in other areas where there is an interest in simultaneously making up the hairs and the underlying skin.

The applicator 2 has an applicator member 10 situated at the end of a stem 7 that is connected at the other end to a gripping member 6, which also constitutes a member for closing the container 3.

The container 3 has a threaded neck 7 and a wiping member 8 for wiping the applicator member 10 as it leaves the container.

Figure 2:
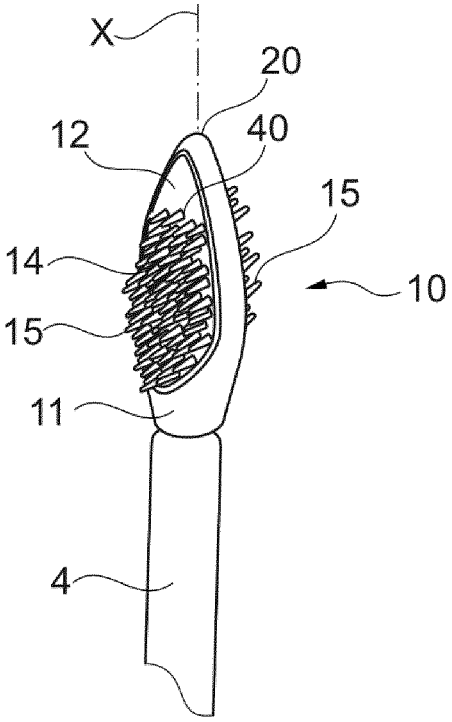
FIG. 2 shows the applicator member mounted on the application stem.
Figure 3:
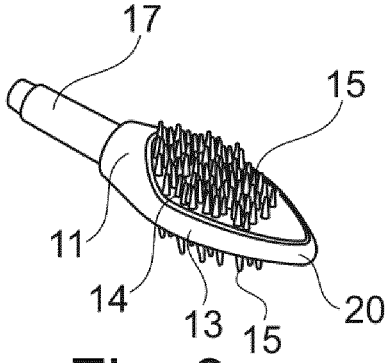
FIG. 3 shows the applicator member as molded, before it is flocked and mounted on the stem of the applicator.

With reference to FIG. 2, it is apparent that the applicator member 10 has a body 11 made of thermoplastic material, which is provided at its distal end with a flocked zone 12.

In the example in question, the longitudinal axis X of the applicator member 10 is coincident with the longitudinal axis Y of the stem 4.

FIGS. 3 to 7 show the applicator member 10 as it is molded, before its end has been flocked and it has been mounted on the stem 4.

Figure 7:
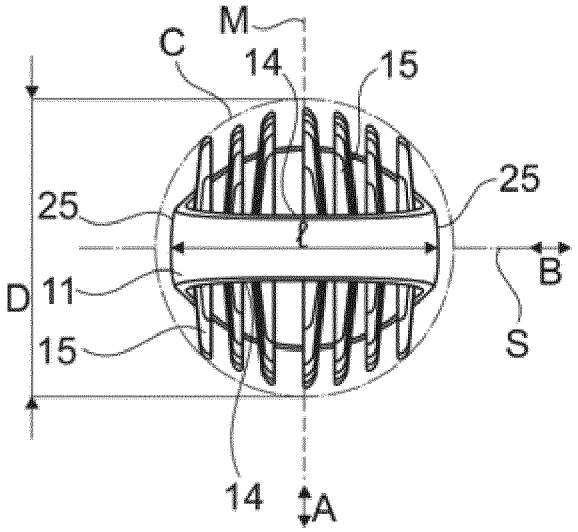
FIG. 7 is an end-on view along VII in FIG. 4.

The body 11 has a portion 13 of flattened cross section, of thickness e in a direction A and width l in a direction B, as illustrated in FIG. 7.

The portion 13 has two opposite main faces 14, which define application faces and to which spikes 15 are attached.

The applicator member 10 is symmetric, in the example in question, with respect to a plane of symmetry S intersecting the body 11 half-way through the thickness thereof.

Figure 5:
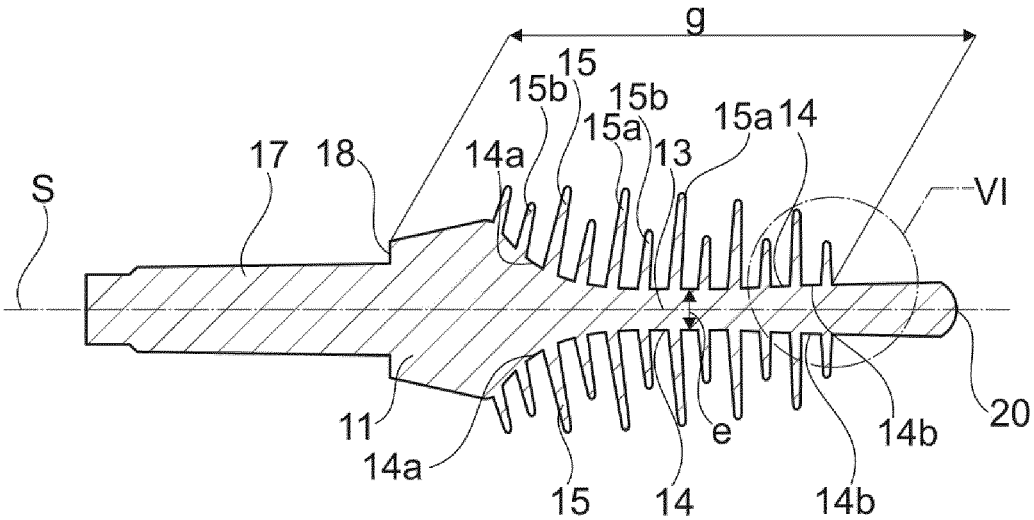
FIG. 5 is a section on V-V in FIG. 4.

The faces 14 have a curved rear portion **14*a* that is concave toward the outside when the applicator member is viewed in section in a median longitudinal plane M, as in FIG. 5, and a front portion 14*b*** that is substantially rectilinear in section in said median plane M.

Figure 4:
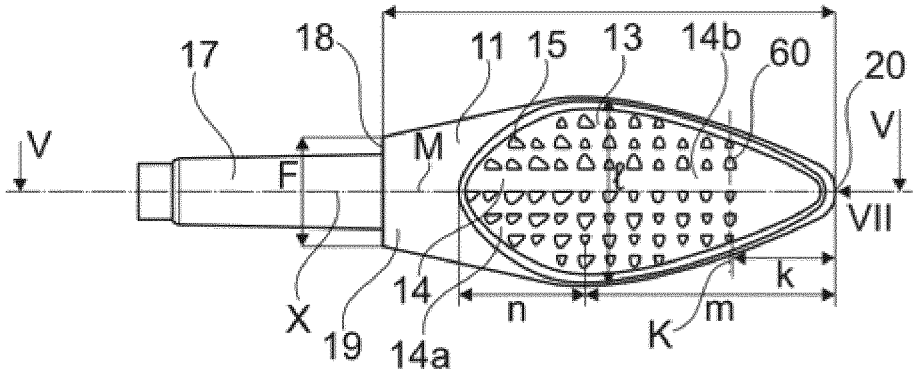
FIG. 4 is a top view of the applicator member.

In the example illustrated, the spikes 15 are organized in rows that extend parallel, in top view as in FIG. 4, to the longitudinal axis X of the applicator member 10.

The applicator member 10 has for example a central row of spikes and a plurality of lateral rows, with a decreasing number of spikes with increasing distance from the median plane M.

For example, the applicator member 10 has twelve spikes in the central row, then eleven, ten and five spikes 15 in the lateral rows.

Within one row, the spikes 15 are not all the same height, as can be seen in particular in FIG. 5.

For example, as illustrated, each row has an alternation of long spikes **15*a* and short spikes 15*b***.

The spikes 15 that are attached to the front portion **14*b* are substantially perpendicular to the latter, while the spikes that are attached to the concave rear portion 14*a* make an angle with the normal to the body 11** at their base and are inclined slightly forward.

The different rows of spikes 15 each extend parallel to the median plane M when the applicator member 10 is viewed along its longitudinal axis, as in FIG. 7.

The applicator member 10 is inscribed in cross section in a circle C of diameter D of for example between 4 and 8 mm, circumscribed by the free ends of the largest spikes of the rows that are farthest from the median plane M, as can be seen in FIG. 7.

Figure 6:
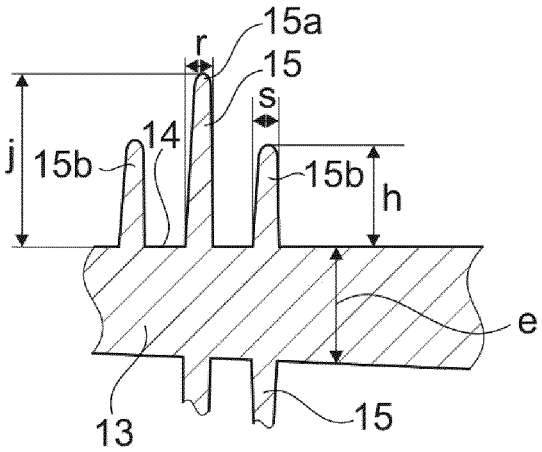
FIG. 6 shows the detail VI in FIG. 5.

With reference to FIG. 6, it is apparent that the length j of the long spikes **15*a*** is for example between 1.8 mm and 2.2 mm and that h of the short spikes is for example between 0.9 and 1.3 mm. The thickness r of the long spikes, at their base, is for example 0.32 mm, and that s of the short spikes is 0.28 mm.

The body 11 is extended on the proximal side by an end piece 17 for fastening in the stem 4, the end piece 17 forming a shoulder 18 at its base.

The diameter F of the body 11 at the shoulder 18 is for example around 3.5 mm.

The body 11 has a portion 19 that diverges toward the front from the shoulder 18. This portion 19 delimits the application face 14 at the rear.

The flocked zone 12 extends over a distance k, measured between the distal end 20 of the body 11 and the farthest forward spikes 15 of the rows. There is no flocking other than in this zone. The distance k is for example between 2 and 6 mm.

As can be seen in FIG. 4 in particular, each face 14 has, in top view, a droplet shape, and the width l decreases in the direction of the distal end over a distance m that is greater than the distance n over which the width l of the applicator member increases when one moves from the rear to the front.

At the point at which the width l of the applicator member 10 is at a maximum, it measures for example between 4 and 8 mm.

The distance n is for example around 4 and the distance m for example around 6 mm.

Each face 14 may be slightly concave in cross section, perpendicularly to the axis X, as illustrated in FIG. 7. The body 11 thus has a double-spoon structure, with concavities on either side of the plane of symmetry S.

In the example illustrated, the spikes 15 have a flat face 22*a* toward the median plane M and a convex opposite face, and have a slight taper toward their free end, as can be seen in FIG. 6.

The distance g that separates the boundary 40 of the flocked zone 12 and the shoulder 18 is for example between 14 and 15 mm.

The contour, in top view, of the applicator member 10 is substantially triangular with a rounded tip, starting from the point at which the width l starts to decrease toward the front.

Thus, the flocked zone 12 has a substantially triangular shape, in top view, with a rounded tip.

In cross section, the sides 25 of the applicator member 10 are slightly curved and convex toward the outside, as can be seen in FIG. 7.

The ratio l/e, which characterizes the flattening of the applicator member 10, is preferably greater than 2, better still greater than 3, even better still greater than 4, and is for example around 4 in the example illustrated, at the point at which the width l is greatest.

In order to manufacture the applicator, the body 11 can be injection molded, for example from a thermoplastic material, in particular a thermoplastic elastomer.

Next, the applicator member 10 can be dipped at its end in an adhesive and then covered electrostatically with flocking to form the flocked zone 12. The length of the flocking is for example around 1 mm. The boundary between the flocked zone and the non-flocked zone can be situated, as illustrated, at the base of the transverse row 60 of spikes 15, of axis K perpendicular to the longitudinal axis X, closest to the distal end 20.

The applicator member 10 is then mounted in the stem 4 and fastened thereto by stapling for example.

The composition P is suitable for making up the eyebrows, the hairs of the bear or the roots of the hair, and preferably contains fibers.

A "fiber" should be understood as being an object of length L and diameter D where L is greater than D, and preferably much greater than D, D being the diameter of the circle in which the section of the fiber is inscribed. In particular, the ratio L/D (or aspect ratio) is chosen in the range from 3.5 to 2500, preferably from 5 to 500 and better still from 5 to 150.

The fibers that usable in the invention may be fibers of synthetic or natural, and mineral or organic, origin. They may be relatively short or long, individual or organized, for example braided, hollow or solid. They may have any shape and may in particular have a circular or polygonal (square, hexagonal or octagonal) cross section depending on the specific application envisaged. In particular, their ends are blunted and/or smoothed to prevent injury.

In particular, the fibers have a length ranging from 1 μm to 10 mm, preferably from 0.1 mm to 6 mm, better still from 0.3 mm to 4 mm and even better still from 0.2 mm to 2 mm. Their section may be contained in a circle with a diameter ranging from 2 nm to 500 μm, preferably ranging from 100 nm to 100 μm and better still from 1 μm to 50 μm. The weight or yarn count of the fibers is often given in denier or decitex and represents the weight in grams per 9 km of yarn. Preferably, the fibers according to the invention have a yarn count chosen in the range from 0.01 to 10 denier, preferably from 0.1 to 2 denier and better still from 0.3 to 0.7 denier.

The fibers that are usable in the compositions according to the invention can be chosen from rigid or non-rigid fibers, and they may be of synthetic or natural, and mineral or organic, origin.

Furthermore, the fibers may or may not be surface-treated, may be coated or uncoated, and may be colored or uncolored.

As fibers that are usable in the compositions according to the invention, mention may be made of non-rigid fibers such as polyamide (Nylon®) fibers or viscose fibers (also known as rayon fibers), or rigid fibres such as polyimideamide fibers, such as those sold under the names Kermel® and Kermel Tech® by the company Rhodia or poly(p-phenyleneterephthalamide) (or aramid) fibres sold in particular under the name Kevlar® by the company DuPont de Nemours.

The fibers that are usable in the compositions according to the invention may be fibers of natural origin, among which cotton fibers, bamboo fibers or hemp fibers, or a mixture thereof, can be mentioned in a nonlimiting manner.

The fibers may be present in a content ranging from 0.1% to 30% by weight, more particularly from 0.1% to 25% by weight, and preferably from 0.3% to 10% by weight, relative to the weight of the composition.

Preferably, the content of fibers, if they are present in the composition P, is less than or equal to 10% by weight, and preferably less than or equal to 5% by weight, relative to the weight of the composition.

As a variant, the content of fibers, if they are present in the composition P, ranges from 2 to 25% by weight relative to the weight of the composition.

The composition P may also contain colorants and/or pigments, in particular iron oxides.

The composition P may have a liquid to pasty consistency.

In order to use the device 1, the user withdraws the applicator from the container 3. The double-spoon shape of the body 11, with spikes 15 in the concavity of each application face 14, makes it possible to effectively capture the fibers present in the container 3. The user can use the flocked distal part 12 to draw a line or color the skin at the base of the eyelashes. The spikes 15 are used to comb the eyebrows while loading them with composition. The flocked distal part 12 can also be used to spread the composition over the eyelashes. The hand actions remain simple, and the user does not have to change accessory while applying makeup.

The user can make use of one application face 14 and then of the other to make up one and the same eyebrow.

The user dips the applicator member 10 back in the container as many times as necessary.

The invention is not limited to the example that has just been described.

For example, the applicator member 10 may have only one application face 14.

The disposition of the spikes 15 may be modified, and it is possible in particular to modify the number and/or orientation thereof.

The invention is not limited to the example that has just been described. Other shapes of applicator member are possible, in particular having a tapered end in the direction of the distal end, for example a substantially triangular or rhombus shape.

As indicated above, the invention also applies to the application of makeup to the beard, in particular in order to make up areas having a lower density of hairs or a lack of hairs, caused by hair loss for example, or to make up the roots of the hair.

The invention claimed is:

1. An applicator for applying makeup to keratin fibers, the applicator having an applicator member designed to apply the composition to said fibers, the applicator member comprising:

a plastics body, the cross section of which is flattened along at least a part of its length, the flattened cross section defining a first direction corresponding to the width of the section and a second direction, perpendicular to the first, corresponding to the thickness of the section, the thickness being less than the width, the body having at least one first application face delimiting on one side the thickness of the flattened cross section, spikes attached to the first application face, flocking present on a portion of the surface of the body adjacent to the distal end thereof, a flocked zone extending over a distance, measured between the distal end of the body and the farthest forward spikes of rows, the applicator lacking flocking other than in this zone.

2. The applicator as claimed in claim 1, the flocking continuously covering the entire surface of the body over a given distance from the distal end thereof to the proximal end thereof.

3. The applicator as claimed in claim 2, the boundary between the flocked zone and the non-flocked zone being situated at the base of a transverse row of spikes that is closest to the distal end.

4. The applicator as claimed in claim 1, the body having a second application face delimiting on the opposite side the thickness of the flattened cross section, this second application face bearing spikes.

5. The applicator as claimed in claim 1, the applicator member being symmetric with respect to a median plane of symmetry for the body, intersecting the latter half-way through the thickness thereof.

6. The applicator as claimed in claim 1, the first application face being concave toward the outside.

7. The applicator as claimed in claim 1, the spikes extending over the first application face having different lengths.

8. The applicator as claimed in claim 1, having on the first application face rows of spikes that are parallel to the longitudinal axis of the body.

9. The applicator as claimed in claim 1, the first application face having at least one row of spikes within which long spikes alternate with shorter spikes.

10. The applicator as claimed in claim 1, the first application face having, when seen from above, a tapered shape that narrows in the direction of the distal end of the applicator member.

11. The applicator as claimed in claim 1, the free end of the spikes attached to the first application face defining a surface that is convex toward the outside.

12. The applicator as claimed in claim 1, the spikes attached to the first application face comprising a first group of spikes that are parallel to one another and perpendicular to a median plane of symmetry, close to the distal end of the applicator member, and a second group of spikes that each make a non-right angle with said median plane of symmetry.

13. The applicator as claimed in claim 1, the height of the spikes attached to the first application face being between 1 and 2.5 mm.

14. The applicator as claimed in claim 1, the keratin fibers not being the eyelashes of the eyelid.

15. A packaging and application device having:

an applicator as defined in claim 1, a container containing a composition for making up human keratin fibers to be applied with the aid of said applicator.

16. The device as claimed in claim 15, the composition comprising fibers.

17. A method for making up human keratin fibers comprising the application of the composition simultaneously to said fibers by means of the applicator of the device as defined in claim 15.

18. The method as claimed in claim 17, said keratin fibers being hairs of the eyebrows, hairs of the beard or the roots of the hair.

* * * * *